US005557894A

United States Patent [19]

Card

[11] Patent Number: 5,557,894

[45] Date of Patent: Sep. 24, 1996

[54] WINDOW ASSEMBLY FRAME

[75] Inventor: Geoffrey C. Card, Roscoe, Ill.

[73] Assignee: Stectus Systems-Midwest, Winnebago, Ill.

[21] Appl. No.: 387,076

[22] Filed: Feb. 13, 1995

[51] Int. Cl.[6] ..... E06B 3/00

[52] U.S. Cl. ..... 52/204.595; 52/204.55; 52/204.5; 52/204.51; 52/98; 52/213

[58] Field of Search ..... 52/213, 204.5, 52/98, 100, 204.51, 204.53, 204.55, 204.595, 204.6, 217; 49/DIG. 2, 407, 414, 504, 402, 411

[56] References Cited

U.S. PATENT DOCUMENTS 2,663,390 12/1953 Dordel .
2,755,895 7/1956 Walterman .
3,694,961 10/1972 Johnson ..... 52/213 X
3,984,955 10/1976 Yamamoto et al. ..... 52/213 X
4,505,080 3/1985 Sailor .
4,614,067 9/1986 Matsubara .
5,435,106 7/1995 Garries et al. ..... 52/204.5

*Primary Examiner*—Carl D. Friedman
*Assistant Examiner*—W. Glenn Edwards
*Attorney, Agent, or Firm*—Richard C. Litman

[57] ABSTRACT

The invention relates to a framing member for attaching panelling and windows to building structures which includes an integral and detachable J-shaped member and nail fin which obviate the need for decorative molding to mask the junction between the framing member and the underlying building structure. The J-member and nail fin may be broken away from the framing member to allow framing members to be attached to one another via a mullion strip to define a mullion between windows or panelling.

13 Claims, 4 Drawing Sheets

WINDOW ASSEMBLY FRAME

BACKGROUND OF THE INVENTION

1. Field of the Invention

This invention relates to frames for attaching panelling or closures to buildings. Specifically, the present invention relates to frames for installing windows in buildings.

2. Description of the Prior Art

Introduction of standardized framing materials in post-World War II housing construction revolutionized the industry. Standardized framing materials improved fabrication efficiency while heightening structural integrity. Window installation, a previously difficult, time-consuming task, has been made considerably easier due to pre-manufactured, self-aligning frames which can be easily tacked into place and sealed. Window frames, typically metal frames, in addition to performing structural tasks, however, must also exhibit aesthetic properties. To this end, window frames are usually constructed in attractive shapes and colors to satisfy differing consumer tastes.

An unfortunate drawback to standardized framing materials is that they are not always suited for every type of architectural configuration. In some cases, they may actually create an unsightly appearance. As a result, frame manufactures normally provide builders with decorative moldings to mask the deleterious effects created by using standard frames in non-standard environments. The use of such decorative moldings, however, adds to the cost of construction, a problem which the use of standard framing materials was designed to eliminate.

Additionally, decorative moldings are often manufactured from different materials from that of the frames. Consequently, the framing and the decorative moldings weather at different rates. This causes discoloration of the moldings relative to the frames to which they are attached. For these reasons, development of a standardized frame which eliminates the need for moldings would greatly benefit the housing construction industry and, ultimately, homeowners.

A number of references in the patent literature address standardized frames and framing designs. For example, U.S. Pat. No. 2,663,390, issued Dec. 22, 1953, to Walter R. Dordel, describes a frame for receiving dry wall panelling which includes a U-shaped channel having a long flange and a short flange. The long flange may be fastened to a building structural member. The long flange also includes a dart which creates a non-parallel alignment of one flange to another and operates to wedge panelling into place as it is inserted farther into the channel. The short flange has an inwardly hemmed edge which operates as a retaining tooth.

U.S. Pat. No. 2,755,895, issued Jul. 24, 1956, to Fredrick H. Walterman, describes a frame for receiving dry wall panelling which includes a semi-parabolically-shaped channel with a long, curved flange and a short, straight flange. The curved flange may be fastened to a structural member of a building. The straight flange laps the edge of the dry wall received within the channel, while the curved flange operates to wedge the panel member against the back side of the straight flange.

U.S. Pat. No. 4,505,080, issued Mar. 19, 1985, to Vernon R. Sailor, describes a frame including a panel-receiving, U-shaped channel having a short and a long member which both extend away from the same leg of the channel. The long member extends from the end of the channel leg and may be attached to a building structural member with fasteners. The long member includes a means for attaching a molding. The short member extends from the base of the channel and also includes a means for attaching a molding. The molding snaps onto the short and long member attachment means described above and hides the fasteners used to attach the long member to the building structural member.

U.S. Pat. No. 4,614,067, issued Sep. 30, 1986, to Isamu Matsubara, describes a frame and molding for installing adjacent windows in a building. Matsubara's invention embraces exactly what the present invention proposes to eliminate: The necessity of interposing a molding to bridge an unsightly gap between symmetrically disposed frames employed to install adjacent windows.

None of the above references, taken alone or in any combination, are seen as teaching or suggesting the presently claimed frame.

SUMMARY OF THE INVENTION

The present invention relates to frames for installing single or multiple windows in a building. Without the present invention, the installation of window assemblies using standardized framing materials requires the use decorative moldings to bridge the unsightly gaps between the framing material and the building structure to which the frame is attached. Also, the conventional installation of abutting windows requires the use of a mullion therebetween, and another decorative molding to bridge the unsightly gap created by abutting frames. The present invention eliminates the need for decorative moldings by providing a framing material which includes one or more integral break-away members which may either be left in place, to bridge a gap, or to facilitate attachment of the framing material to the underlying structure; or may be broken off to allow two framing members to be combined to define a mullion between two panels or windows.

In consideration of the above, it is an object of the invention to provide a framing material which enables a user to install one or more windows in a building structure without creating any unsightly gaps between the frame and the building structure.

It is another object of the present invention to provide a framing material which does not require the use of decorative trim moldings to render the frame aesthetically pleasing.

Another object of the invention is to provide a framing material which is capable of receiving a wide range of shapes and sizes of panelling, windows, and doors, which is both low in cost, and easily installed.

A further object of the invention is to provide a frame which is relatively maintenance-free.

It is yet another object of the present invention to provide a framing member which, upon the removal of one or more integral parts thereof, may be mated with another, identical framing member to define a mullion between two panels or windows.

These and other objects of the present invention will become readily apparent upon further review of the following specification and drawings.

BRIEF DESCRIPTION OF THE DRAWINGS

Identical reference characters denote corresponding features consistently throughout the attached drawings.

DETAILED DESCRIPTION OF THE PREFERRED EMBODIMENT

Figure 1:
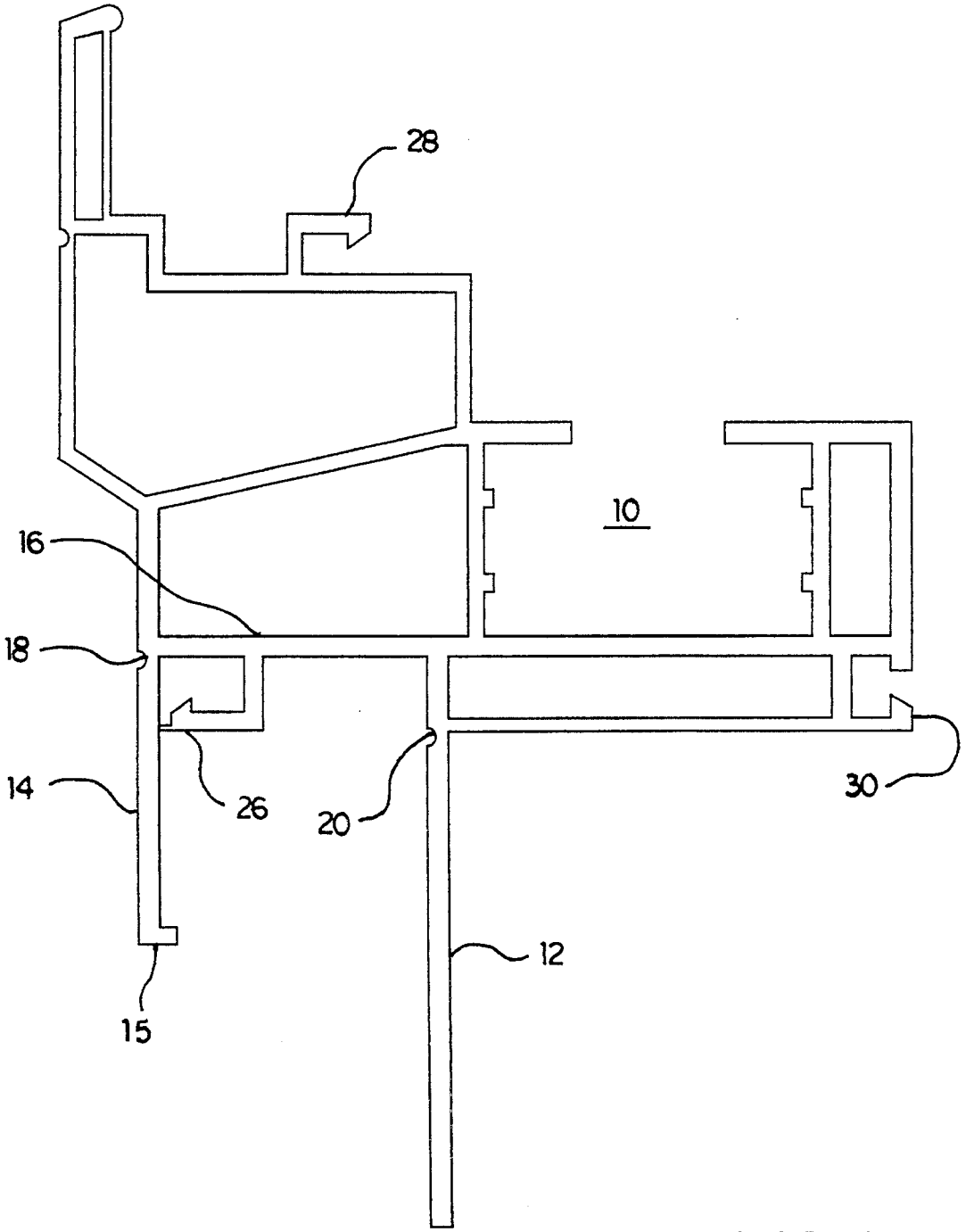
FIG. 1 is a cross-sectional view of an embodiment according to the present invention.

Referring to FIG. 1, the claimed framing member is shown having an open channel 10 for receiving a window sash. The framing member may also include means defining any number of hollow enclosures therein. As shown in FIG. 1, the framing member includes five hollow enclosures. The enclosures give the framing member low weight and structural rigidity, while keeping its construction costs low.

A nail fin 12 permits rigid attachment of the framing member to a building structural member (not shown) with a nail or threaded fastener (not shown). Nail fin 12, J-shaped member 14, and frame member 16 define another channel for receiving panelling and provide an attractive covering for the panelling edge. J-shaped member 14 is dimensioned and configured to overlie a gap between the framing member and the building structure to which the framing member is attached. Flange 15 is provided to retain a bead of silicone (not shown) to seal the framing member to a building structure.

Notch 18 in J-shaped member 14 permits ready, break-away detachment of J-shaped member 14. Detachment of J-shaped member 14 permits adjacent, symmetrical disposition of two frames, as discussed below. Notch 20 in nail fin 12 permits ready, break-away detachment of nail fin 12. Detachment of nail fin 12 also facilitates adjacent, symmetrical disposition of two framing members.

Elongate retainer clips 26, 28, and 30 are included to provide various attachment points from which the framing member may be attached to a building structure. This allows the framing member to be used in a large number of different building applications, including both standard applications and customized applications. Retainer clip 26 also serves as an attachment point from which two symmetrically-disposed framing members may be joined together via a mullion strip (see below) to define a mullion between two panels or windows.

Figure 2:
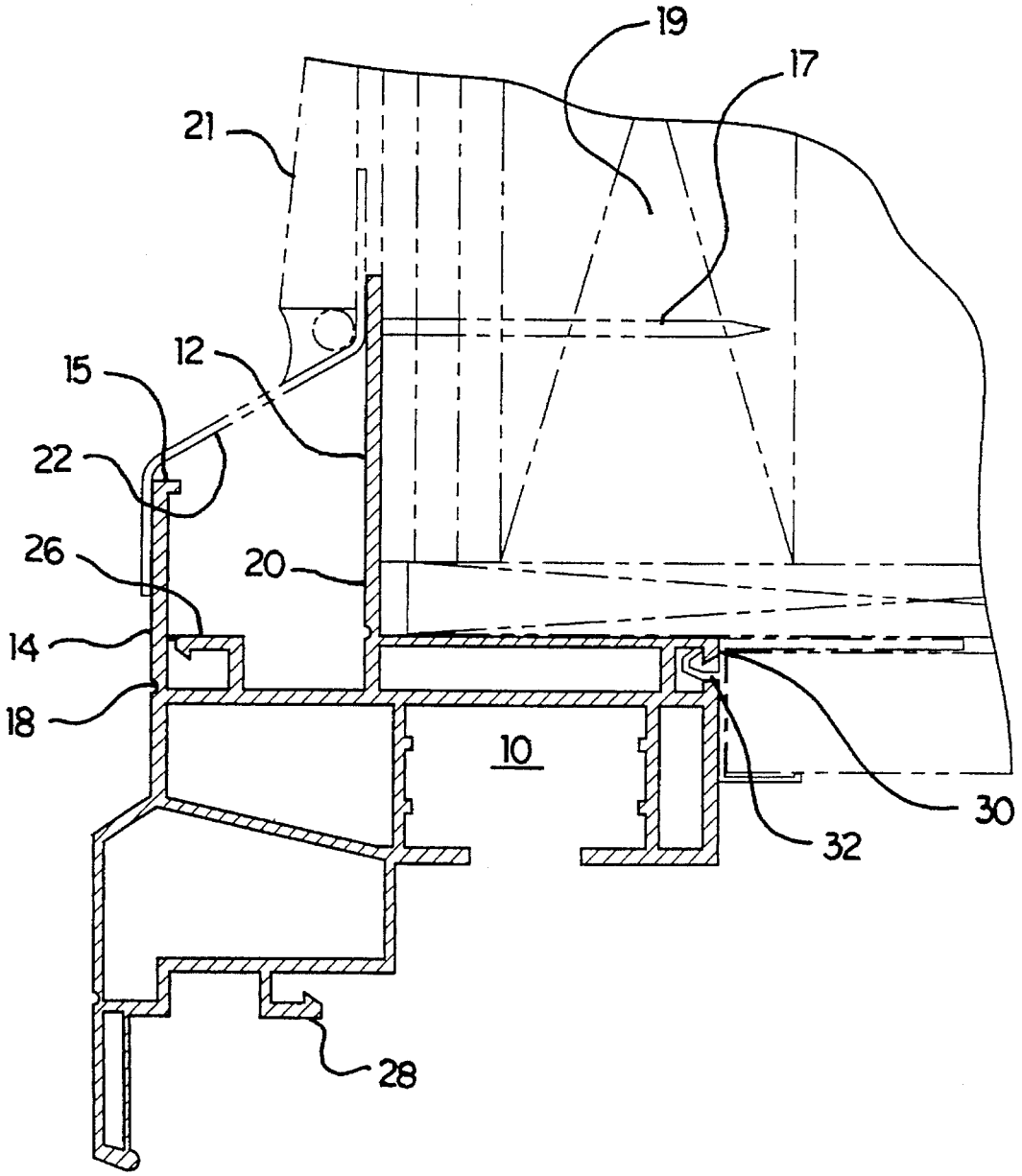
FIG. 2 is an environmental cross-sectional view of the embodiment shown in FIG. 1, depicting the invention incorporated into the head of a window frame.

Referring now to FIG. 2, the invention is shown installed in a building structure as the horizontal head portion of a window frame. As shown in FIG. 2, the framing member is an inverted mirror image of the view shown in FIG. 1. A nail 17 is shown passing through nail fin 12, to attach the framing member to a building structural member 19. Additionally, retainer clip 30 is shown fastened to a matingly engageable clip 32 on the building structure. Flashing 22 covers the edge of J-shaped member 14 to provide a weather-resistant junction between outer panelling 21 and the framing member.

Figure 3:
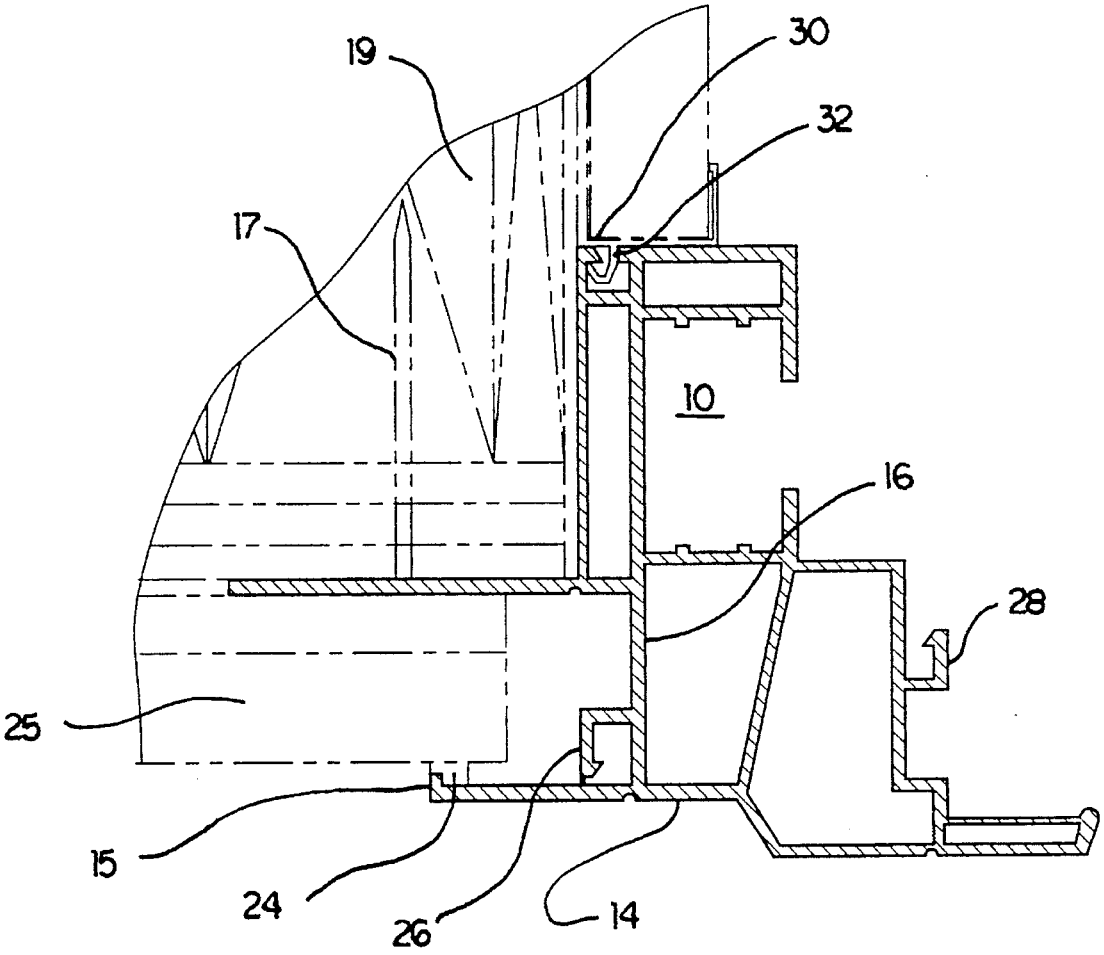
FIG. 3 is an environmental cross-sectional view of the embodiment shown in FIG. 1, depicting the invention incorporated into the jamb of a window frame.

Referring now to FIG. 3, an embodiment of the present invention is shown installed in a building as the vertical jamb portion of a window frame. As in FIG. 2, a nail 17 is shown passing through nail fin 12, and into building structure 19, and retainer clip 30 is matingly engaged to clip 32 of the underlying structure. Flange 15 of J-shaped member 14 retains a silicone bead 24 against outer panelling 25, thereby providing a weather-resistant junction between panelling 25 and the framing member. Since silicone bead 24 is retained behind tooth 15, an outside observer will not see the bead, but rather only smooth seam between panelling 25 and tooth 15 of J-shaped member 14.

Figure 4:
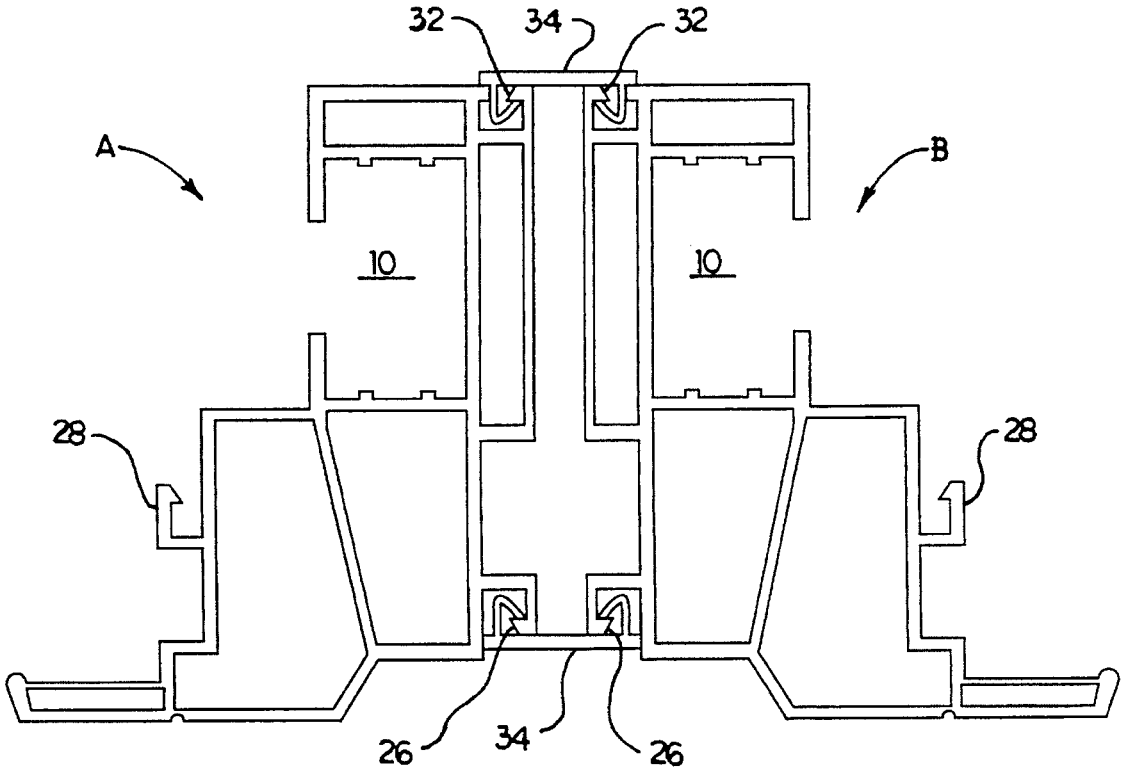
FIG. 4 is a cross-sectional view of two symmetrically disposed embodiments of the invention as shown in FIG. 1 joined together to define a mullion.

Referring now to FIG. 4, two symmetrically-disposed framing members A and B according to the present invention are shown in back-to-back abutment to permit installation of adjacent window or panelling assemblies in a building. The nail fin 12 and J-shaped member 14 of both framing members A and B has been removed to allow unfettered access to retainer clips 26 on both framing members. Two mullion strips 34, dimensioned and configured to matingly interengage with retainer clips 26 and 32, fasten the two framing members A and B together to define a mullion. As shown here, the outer surface of the mullion strip can either overlie the junction between the two framing members (upper part of the view), or be flush to, or recessed from the framing members (lower part of the view).

Figure 5:
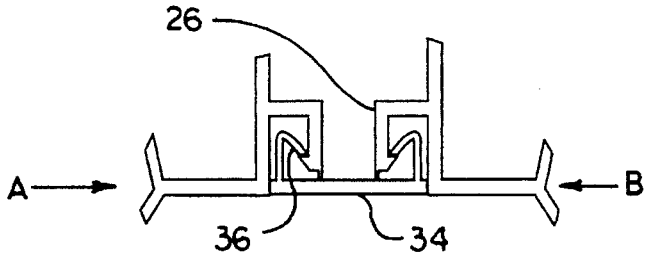
FIG. 5 is a cross-sectional magnified view of a mullion strip between the two framing members shown in FIG. 4.

FIG. 5 shows a magnified view of the mullion strip 34 shown in FIG. 4. The mullion strip 34 includes two retainer clips 36. The retainer clips 36 of the mullion strip 34 are dimensioned and configured to matingly engage with retainer clips 26 and 32 (not shown) of framing members A and B.

The present invention is limited to the sole embodiment described above, but encompasses any and all embodiments within the scope of the following claims.

I claim:

1. An integral framing member comprising:

an integral nail fin having a notch therein, whereby said integral nail fin may be removed from said integral framing member;

an integral J-shaped member having a notch therein, whereby said integral J-shaped member may be removed from said integral framing member, said integral J-shaped member dimensioned and configured to overlie a gap between said framing member and a building structure;

a frame member having a first end and a second end, said frame member connecting said integral nail fin and said J-shaped member;

said frame member, said integral nail fin, and said J-shaped member defining a first channel therebetween; p1 a first retention clip connected to said first end of said frame member and disposed within said first channel; and said framing member including means defining a second channel therein.

2. The integral framing member according to claim 1, further comprising a second retention clip connected to said second end of said frame member.

3. The integral framing member according to claim 2, further comprising a third retention clip.

4. The integral framing member according to claim 1, further comprising means defining first, second, third, fourth, and fifth hollow enclosures therein.

5. In combination, an integral framing member and at least one mullion strip, said integral framing member comprising:

an integral nail fin, said integral nail fin having a notch therein for selectively removing said integral nail fin from said integral framing member;

an integral J-shaped member, said integral J-shaped member having a notch therein for selectively removing said integral J-shaped member from said integral framing member, said integral J-shaped member dimensioned and configured to overlie a gap between said framing member and a building structure;

a frame member having a first end and a second end, said frame member connecting said integral nail fin and said J-shaped member;

said frame member, said integral nail fin, and said J-shaped member defining a first channel therebetween;

a first retention clip connected to said first end of said frame member and disposed within said first channel;

a second retention clip connected to said second end of said frame member; and said framing member including means defining a second channel therein; and said at least one mullion strip being dimensioned and configured to interengage with said first and second retention clips of said framing member when said integral nail fin and said integral J-shaped member have been selectively removed from said integral framing member, whereby two of said framing members may be fastened together to define a mullion.

6. The combination according to claim 5, wherein said integral framing member further comprises a third retention clip.

7. The combination according to claim 6, wherein said integral framing member further comprises means defining first, second, third, fourth, and fifth hollow enclosures therein.

8. The combination according to claim 5, wherein said at least one mullion strip includes two retention clips, said two retention clips of said at least one mullion dimensioned and configured to interengage with said first and second retention clips of said framing member when said integral nail fin and said integral J-shaped member have been selectively removed.

9. The combination according to claim 5, further comprising a second mullion strip being dimensioned and configured to interengage with said first and second retention clips of said framing member when said integral nail fin and said integral J-shaped member have been selectively removed from said integral framing member.

10. An integral framing member comprising:

an integral nail fin;

an integral J-shaped member dimensioned and configured to overlie a gap between said framing member and a building structure, said J-shaped member including means for permitting break-away removal of said J-shaped member from said integral member;

a frame member having a first end and a second end, said frame member connecting said integral nail fin and said J-shaped member;

said frame member, said integral nail fin, and said J-shaped member defining a first channel therebetween;

a first retention clip connected to said first end of said frame member and disposed within said first channel; and said framing member including means defining a second channel therein.

11. The integral framing member according to claim 10, further comprising a second retention clip connected to said second end of said frame member.

12. The integral framing member according to claim 10, further comprising a third retention clip.

13. The integral framing member according to claim 10, further comprising means defining first, second, third, fourth, and fifth hollow enclosures therein.

* * * * *